US010806307B2

(12) United States Patent
Danis

(10) Patent No.: US 10,806,307 B2
(45) Date of Patent: Oct. 20, 2020

(54) DISPENSING ASSEMBLY FOR PAPER PRODUCTS

(71) Applicant: Christopher J. Danis, Centerville, OH (US)

(72) Inventor: Christopher J. Danis, Centerville, OH (US)

( * ) Notice: Subject to any disclaimer, the term of this patent is extended or adjusted under 35 U.S.C. 154(b) by 41 days.

(21) Appl. No.: 16/226,762

(22) Filed: Dec. 20, 2018

(65) Prior Publication Data

US 2020/0196807 A1 Jun. 25, 2020

(51) Int. Cl.

| | |
|---|---|
| ***A47K 10/36*** | (2006.01) |
| ***A47K 10/40*** | (2006.01) |
| *A47K 10/38* | (2006.01) |
| *A47K 10/32* | (2006.01) |

(52) U.S. Cl.

CPC ..... *A47K 10/3637* (2013.01); *A47K 10/40* (2013.01); *A47K 2010/3233* (2013.01); *A47K 2010/3266* (2013.01); *A47K 2010/3863* (2013.01)

(58) Field of Classification Search

CPC .... A47K 10/3637; A47K 10/40; A47K 10/32; A47K 10/36; A47K 10/38; A47K 10/3612; A47K 2010/3266; A47K 2010/3233; A47K 2010/389

See application file for complete search history.

(56) References Cited

U.S. PATENT DOCUMENTS

| | | | | |
|---|---|---|---|---|
| 2,440,974 A * | 5/1948 | Resch | A47K 10/32 312/31 |
| 3,494,518 A * | 2/1970 | Goss | A47K 10/38 225/34 |
| 3,729,145 A * | 4/1973 | Koo | A47K 10/32 242/596.5 |
| 3,837,595 A * | 9/1974 | Boone | A47K 10/32 242/594.5 |
| 4,165,138 A * | 8/1979 | Hedge | A47K 10/3656 242/560 |
| 4,235,333 A * | 11/1980 | Boone | A47K 10/32 206/233 |
| 4,406,421 A | 9/1983 | Schultz et al. | |
| 4,699,304 A | 10/1987 | Voss et al. | |
| 4,846,412 A * | 7/1989 | Morand | A47K 10/3687 242/560.1 |
| 5,154,496 A * | 10/1992 | Campbell | A47K 10/32 221/199 |
| 5,228,632 A * | 7/1993 | Addison | A47K 10/3827 206/409 |
| 5,311,986 A | 5/1994 | Putz | |
| 5,318,210 A * | 6/1994 | Morand | A47K 10/38 225/43 |

(Continued)

*Primary Examiner* — Michael E Gallion

(74) *Attorney, Agent, or Firm* — The Law Office of Patrick F. O'Reilly III, LLC

(57) ABSTRACT

A dispensing assembly attachable to a fixed substrate is provided. The dispensing assembly may comprise: a housing comprising a first side panel, a second side panel, a top panel, and a back panel that together define a compartment; and a cartridge that may be removably received in the compartment of the housing. The cartridge may comprise a first side, a second side, a third side, a fourth side, a top, and a bottom. One or more portions of the cartridge may engage one or more structures formed on an inner surface of the compartment.

19 Claims, 5 Drawing Sheets

(56) References Cited

U.S. PATENT DOCUMENTS 5,604,992 A * 2/1997 Robinson ..... A47K 10/485 242/559
5,680,978 A * 10/1997 Pinion ..... B65D 85/672 220/230
5,697,577 A * 12/1997 Ogden ..... A47K 10/38 242/596.8
5,897,074 A * 4/1999 Marino ..... A47K 10/38 242/594.1
5,950,960 A 9/1999 Marino
5,979,822 A * 11/1999 Morand ..... A47K 10/3656 242/560
6,059,882 A * 5/2000 Steinhardt ..... A47K 10/32 118/264
6,102,269 A 8/2000 Elliott et al.
6,213,344 B1 4/2001 Hill
6,224,010 B1 5/2001 Morand
6,273,359 B1 * 8/2001 Newman ..... A47K 10/32 221/303
6,319,318 B1 * 11/2001 Pekarek ..... A47K 10/34 118/249
D462,215 S 9/2002 Bartelt et al.
6,476,365 B1 * 11/2002 Rios ..... A47K 10/38 219/521
6,497,345 B1 12/2002 Wilker et al.
6,537,631 B1 * 3/2003 Rivera ..... A47K 10/32 428/36.91
6,568,625 B2 5/2003 Faulks et al.
6,604,628 B1 8/2003 Tanaka et al.
6,696,025 B2 2/2004 Liao
6,706,352 B2 3/2004 Rivera et al.
6,745,975 B2 6/2004 Faulks et al.
6,826,985 B2 * 12/2004 Broehl ..... B65H 35/08 225/1
6,827,309 B1 12/2004 Newman et al.
6,929,148 B2 8/2005 Haddad et al.
6,959,890 B1 11/2005 Breitinger
6,997,342 B2 2/2006 Mitchell et al.
7,128,235 B2 10/2006 Haddad et al.
D552,902 S 10/2007 Sadeh et al.
7,294,378 B2 11/2007 Rivera et al.
7,357,350 B1 4/2008 Rogers
7,410,052 B2 8/2008 Cook et al.
7,481,395 B2 1/2009 Rogers
7,527,218 B2 5/2009 Brown
D609,039 S 2/2010 Serfaty
7,694,848 B2 4/2010 Petry
7,726,513 B2 6/2010 Schlaupitz et al.
D634,138 S 3/2011 Wallace
8,550,296 B2 10/2013 Gerschwiler Steck et al.
8,616,489 B2 * 12/2013 Goeking ..... A47K 10/3687 242/564.4
8,783,601 B1 * 7/2014 Shala ..... A47K 10/16 242/596.8
8,991,647 B2 * 3/2015 Meyers ..... A61L 2/22 221/96
D764,208 S 8/2016 Shafran
9,526,383 B2 * 12/2016 Delaney ..... A47K 10/38
9,579,000 B1 2/2017 Morris et al.
9,999,326 B2 * 6/2018 Borke ..... A47K 10/36
10,034,586 B2 7/2018 Goble
10,045,669 B2 8/2018 Morand
10,117,549 B2 * 11/2018 Atalla ..... A47K 10/38
10,123,666 B2 * 11/2018 Ruthven ..... A47K 10/3687
10,143,340 B2 * 12/2018 Allard ..... A47K 10/38
10,149,579 B2 * 12/2018 Goltz ..... A47K 10/3618
2002/0096597 A1 * 7/2002 Adelakun ..... A47K 10/3836 242/588.6
2002/0109034 A1 * 8/2002 Moody ..... A47K 10/3687 242/559.1
2004/0124203 A1 * 7/2004 Phelps ..... A47K 10/421 221/34
2007/0034149 A1 2/2007 Gonzalez Escobar
2007/0095769 A1 * 5/2007 Jenkins ..... A47K 10/38 211/119.009
2007/0181594 A1 * 8/2007 Thompson ..... A47K 10/40 221/190
2008/0067185 A1 * 3/2008 Schlaupitz ..... A47K 10/421 221/45
2008/0116314 A1 * 5/2008 Elliott ..... A47K 10/3687 242/596.8
2008/0169411 A1 * 7/2008 Quinn ..... A47K 10/32 248/691
2010/0089940 A1 * 4/2010 Serfaty ..... A47K 10/32 221/34
2010/0237753 A1 * 9/2010 Reynolds ..... A47K 10/32 312/45
2010/0243669 A1 * 9/2010 Rapala ..... A47K 10/185 221/45
2011/0024586 A1 2/2011 Brinkdopke et al.
2011/0108598 A1 * 5/2011 Bruner ..... A47K 10/38 225/10
2012/0181297 A1 7/2012 Cofrancesco
2013/0126665 A1 * 5/2013 Fournier ..... A47K 10/40 242/598.6
2014/0027595 A1 * 1/2014 Hunsaker ..... A47K 10/42 248/318
2014/0076916 A1 3/2014 Boyce
2014/0124525 A1 * 5/2014 Delaney ..... A47K 10/38 221/34
2015/0374182 A1 12/2015 Delaney
2016/0174779 A1 * 6/2016 Yaros ..... A47K 10/3818 242/594
2016/0262581 A1 9/2016 Morand
2017/0042391 A1 * 2/2017 Morand ..... A47K 10/3643
2017/0164794 A1 6/2017 Delaney et al.
2017/0202410 A1 7/2017 Epperley
2017/0225875 A1 8/2017 Schlaupitz et al.
2018/0014701 A1 1/2018 Kennedy
2018/0049602 A1 * 2/2018 Delaney ..... A47K 10/426
2018/0263435 A1 * 9/2018 Osborne, Jr. ..... B65H 35/006
2019/0208966 A1 * 7/2019 Young ..... A47K 10/18

* cited by examiner

DISPENSING ASSEMBLY FOR PAPER PRODUCTS

FIELD OF THE INVENTION

The present invention relates to a dispensing assembly for paper products and, more specifically, to a housing and a cartridge for dispensing pre-wetted paper products.

BACKGROUND OF THE INVENTION

Many conventional combination dispensers for wet and dry paper products (e.g., toilet paper) occupy excessive amounts of space and do not provide convenient access to both the wet and dry paper products. In addition, current dispensers often do not allow for easy replacement or replenishment of the wet paper products by the consumer and fail to provide a barrier to loss of moisture from the wet paper products. Furthermore, some dispensers require installation of special-purpose holders, and dispensers that attach to existing wall-mounted holders may still require modification of the holder, the wall, or other adjacent structure to accommodate the dispenser. Many of these conventional dispensers are not recyclable or may contain one or more components that are not recyclable.

SUMMARY OF THE INVENTION

In accordance with an aspect of the present disclosure, a dispensing assembly attachable to a fixed substrate is provided. The dispensing assembly may comprise: a housing comprising a first side panel, a second side panel, a top panel, and a back panel that together define a compartment; and a cartridge for dispensing a paper product, the cartridge being removably received in the compartment of the housing. The cartridge may comprise a first side, a second side, a third side, a fourth side, a top, and a bottom. One or more portions of the cartridge may engage one or more structures formed on an inner surface of the compartment.

A bottom and a front of the compartment may be open.

The dispensing assembly may further comprise a pair of arms that suspend the housing below the fixed substrate.

The cartridge may be aligned in the compartment and secured to the housing by engagement between the one or more portions of the cartridge and the one or more structures formed on the inner surface of the compartment.

An alignment indent formed in an inner surface of the second side panel of the housing may receive an alignment protrusion extending outward from an outer surface of the first side of the cartridge, and an alignment ridge extending outward from an inner surface of the back panel of the housing may be received in an alignment recess extending inward from an outer surface of the second side of the cartridge.

The cartridge may further comprise a lid and a main body, in which the lid may comprise an active roller and the main body may comprise a passive roller. When the lid is closed, the active and passive rollers may be adjacent to one another and the paper product may be compressed between the active and passive rollers. The cartridge may further comprise a gear and a spring, with the gear being coupled to a lever and to the active roller. When the lever is depressed from a first position, the gear and the active roller may rotate a predefined rotational distance to advance the paper product, and when the lever is released, the spring may bias the lever back to the first position. The paper product may comprise a pre-wetted paper product, and the active and passive rollers may together define a seal that is partially watertight. The lid of the cartridge may be coupled to the main body by a hinge extending longitudinally along at least a portion of the fourth side of the cartridge, in which the paper product may be dispensed from a slot formed in the hinge.

The fixed substrate may comprise a wall-mounted toilet tissue holder, and the dispensing assembly may further comprise a pair of arms that suspend the housing below the fixed substrate. Each of the pair of arms may further comprise a protrusion extending outward from an outer surface for mounting the dispensing assembly to posts of the toilet tissue holder and an indent extending inward from an inner surface for receiving a spindle that supports a roll of a second paper product.

In accordance with another aspect of the present disclosure, another dispensing assembly attachable to a fixed substrate is provided. The dispensing assembly may comprise: a housing comprising a first side panel, a second side panel, a top panel, and a back panel that together define a compartment; and a cartridge for dispensing a paper product, the cartridge being removably received in the compartment of the housing. The cartridge may comprise a lid with an active roller and a main body with a passive roller. The lid of the cartridge may be coupled to the main body by a hinge, in which the paper product may be dispensed from a slot formed in the hinge. When the lid is closed, the active and passive rollers may be adjacent to one another and the paper product may be compressed between the active and passive rollers.

A bottom and a front of the compartment may be open.

The dispensing assembly may further comprise a pair of arms that suspend the housing below the fixed substrate.

The cartridge may comprise a first side, a second side, a third side, a fourth side, a top, and a bottom. An alignment indent formed in an inner surface of the second side panel of the housing may receive an alignment protrusion extending outward from an outer surface of the first side of the cartridge, and an alignment ridge extending outward from an inner surface of the back panel of the housing may be received in an alignment recess extending inward from an outer surface of the second side of the cartridge. The cartridge may be aligned in the compartment and secured to the housing by engagement between the alignment indent and protrusion and between the alignment ridge and recess.

The dispensing assembly may further comprise a gear and a spring, with the gear being coupled to a lever and to the active roller. When the lever is depressed from a first position, the gear and the active roller may rotate a predefined rotational distance to advance the paper product, and when the lever is released, the spring may bias the lever back to the first position.

The paper product may comprise a pre-wetted paper product, and the active and passive rollers may together define a seal that is partially watertight.

The fixed substrate may comprise a wall-mounted toilet tissue holder, and the dispensing assembly may further comprise a pair of arms that suspend the housing below the fixed substrate. Each of the pair of arms may further comprise a protrusion extending outward from an outer surface for mounting the dispensing assembly to posts of the toilet tissue holder and an indent extending inward from an inner surface for receiving a spindle that supports a roll of a second paper product.

In accordance with a further aspect of the present disclosure, a cartridge for dispensing a paper product is provided. The cartridge may comprise: a lid comprising an active roller and a main body comprising a passive roller. The lid may be coupled to the main body by a hinge extending longitudinally along at least a portion of one side of the cartridge. When the lid is closed, the active and passive rollers may be adjacent to one another and the paper product may be compressed between the active and passive rollers.

The paper product may comprise a pre-wetted paper product, and the active and passive rollers may together define a seal that is partially watertight.

The paper product may be dispensed from a slot formed in the hinge.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

Figure 1:
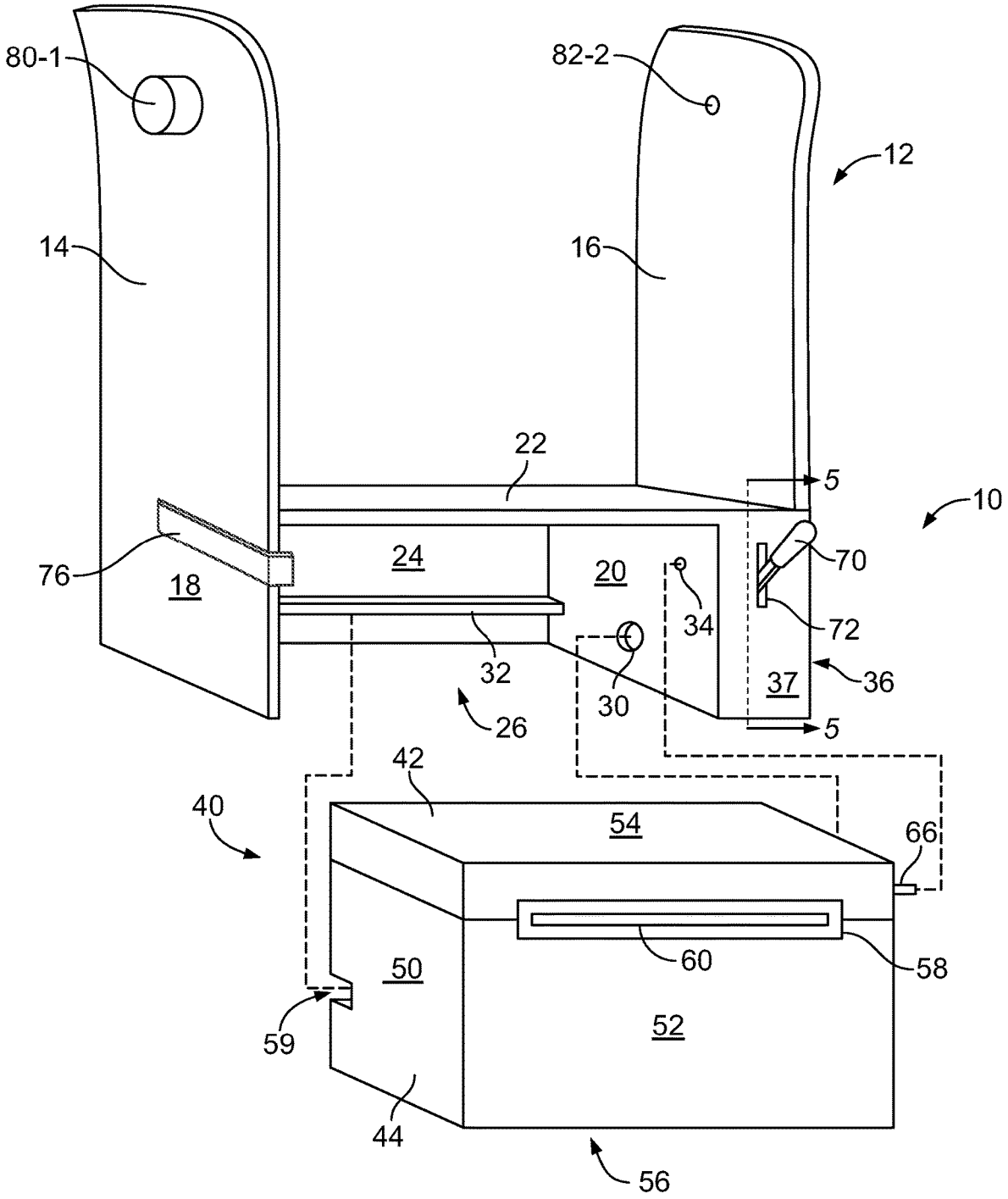
FIG. 1 is an exploded view of a dispensing assembly comprising a housing and a cartridge in accordance with principles of the present disclosure.
Figure 3:
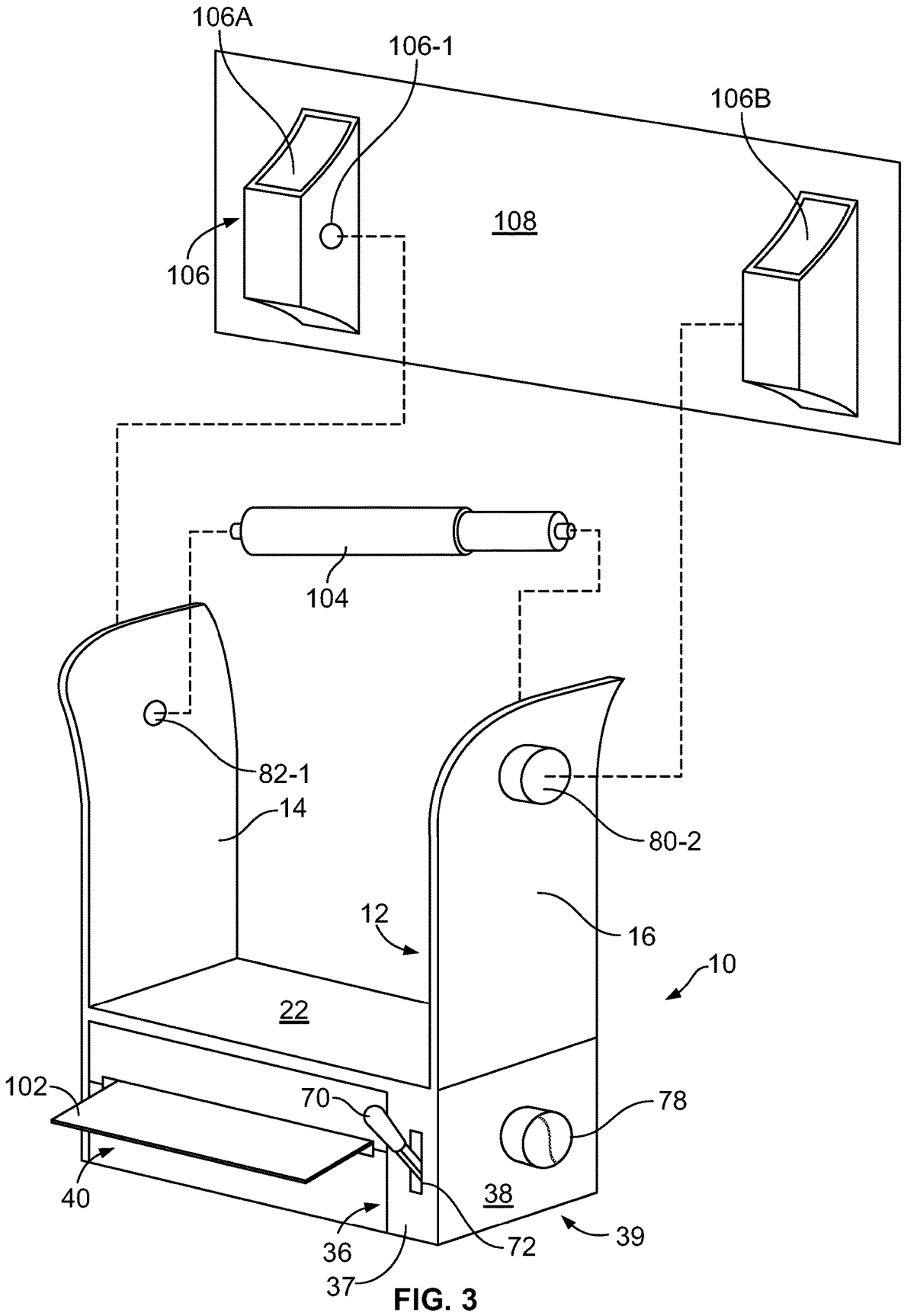
FIG. 3 is an exploded view of the dispensing assembly of FIG. 1 for attachment to a wall-mounted toilet tissue holder.

With reference to FIGS. 1 and 3, a dispensing assembly 10 in accordance with the present disclosure is depicted. The dispensing assembly 10 comprises a housing 12 and a cartridge 40. The housing 12 and the cartridge 40 may each comprise one or more polymeric materials and may consist at least partially of recycled and/or recyclable materials. The housing 12 may comprise a pair of arms 14, 16, a first side panel 18, a second side panel 20, a top panel 22, and a back panel 24. The top panel 22 and back panel 24 extend between and connect the side panels 18, 20. The side, top, and back panels 18, 20, 22, 24 together define a compartment 26 into which the cartridge 40 is removably received, as described herein.

Figure 6:
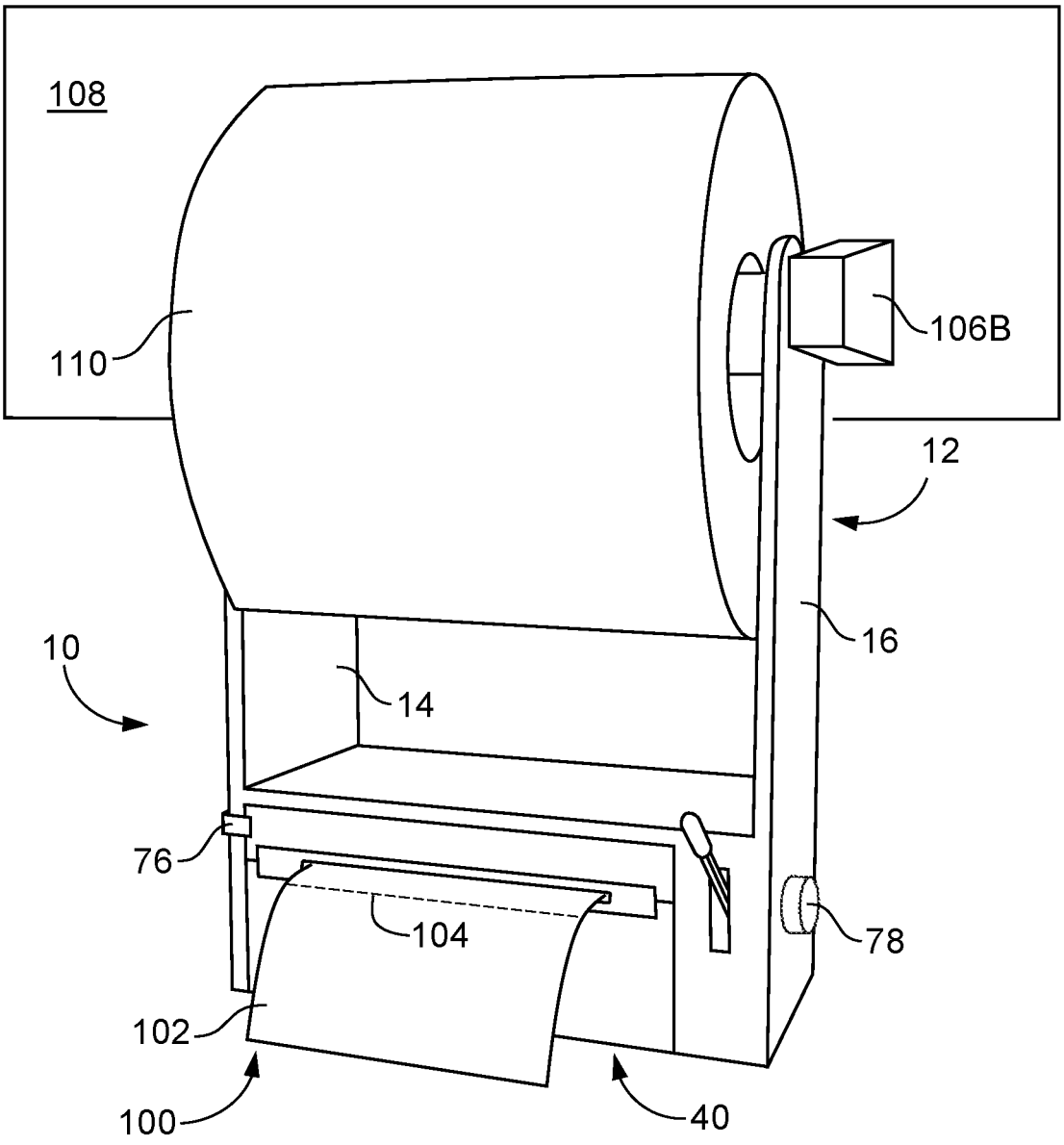
FIG. 6 is a front perspective view of a fully assembled dispensing assembly in accordance with principles of the present disclosure.

The pair of arms 14, 16 suspend the housing 12 below a fixed substrate 106, as shown in FIGS. 3 and 6. The fixed substrate 106 may comprise a variety of styles and may support, for example, a dry paper product such as toilet tissue 110. The fixed substrate 106 may comprise, for example, a wall-mounted toilet tissue holder with a first post 106A and a second post 106B that are mounted to a wall 108. The posts 106A, 106B comprise respective apertures 106-1, 106-2 that would normally receive a conventional spindle 104, which may be a spring-loaded spindle as is known in the art. In some examples as shown in FIGS. 1, 3, and 6, the housing 12 may comprise a structure in which upper portions of each arm 14, 16 comprise a respective protrusion 80-1, 80-2 extending outward from an outer surface of the arm 14, 16. The arms 14, 16 may be moved toward each other and placed between the posts 106-1, 106-2 such that the protrusions 80-1, 80-2 are received by and mounted in the apertures 106-1, 106-2 formed in the posts 106A, 106B of the wall-mounted toilet tissue holder. Following installation, the housing 12 hangs below the fixed substrate 106, as best seen in FIG. 6. The upper portions of each arm 14, 16 comprise indents 82-1, 82-2 extending inward from an inner surface of the respective arm 14, 16. The toilet tissue roll 110 may be placed on the spindle, opposing ends of the spindle 104 may be pushed toward each other, and the spindle 104 may be placed between the arms 14, 16 such that the indents 82-1, 82-2 receive the opposing ends of the spindle 104, with the spring (not shown) in the spindle 104 biasing the opposing ends of the spindle 104 toward a respective one of the arms 14, 16. Following installation of the spindle 104 in the indents 82-1, 82-2, the toilet tissue roll 110 is supported above the compartment 26 that receives the cartridge 40. The structure of the housing 12 shown in FIGS. 1, 3, and 6 allows installation and removal of the spindle 104 and the toilet tissue roll 110 without the need to remove the housing 12 from the fixed substrate 106. The upper portions of the arms 14, 16 may be slightly curved away from each other, as shown in FIGS. 1 and 3, or may be substantially straight or planar, as shown in FIG. 6.

Figure 4:
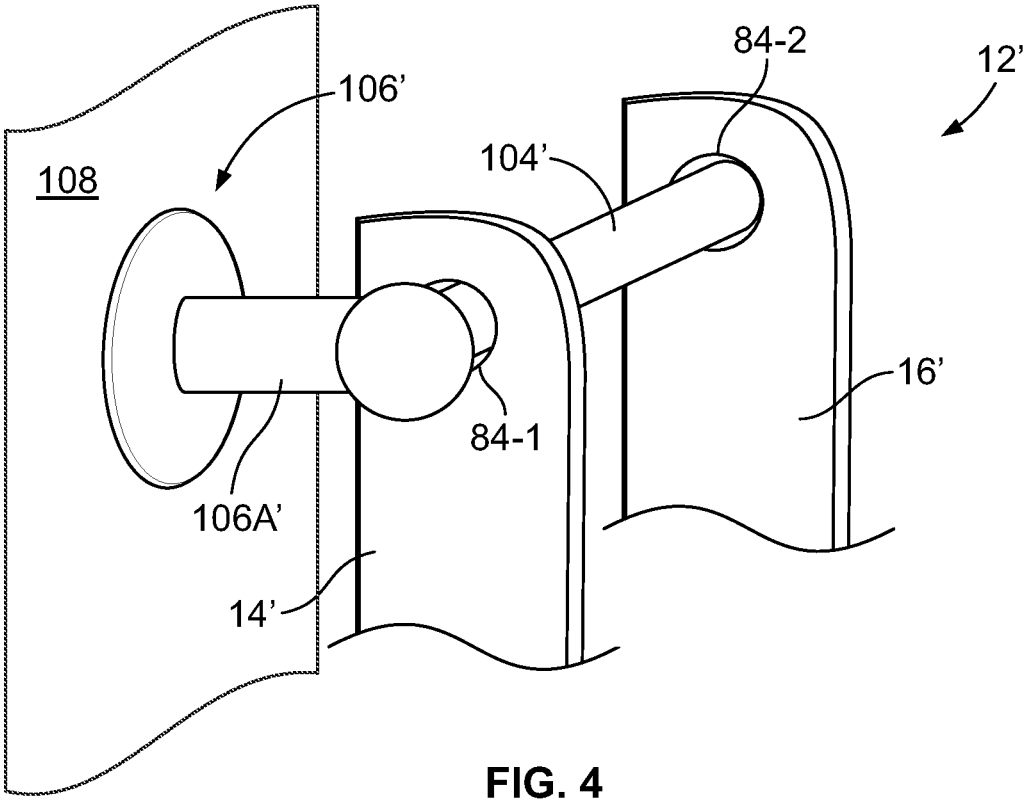
FIG. 4 is a detailed perspective view of a portion of a housing of another dispensing assembly in accordance with principles of the present disclosure.

In other examples as shown in FIG. 4, the fixed substrate 106' may comprise a different type or style of wall-mounted holder, and the housing 12' may comprise a different structure adapted to be attached to the fixed substrate 106'. In some configurations, the fixed substrate 106' may comprise a hinged holder with a bar 104' that is coupled to and pivots about one post 106A'. The pivoting bar 104' may rest on a second post (not shown). In other instances, the fixed substrate 106' may comprise a single post 106A', and the bar 104' may be fixed to (i.e., not movable relative to) the post 106A'. In all instances, the bar 104' may serve as a spindle to support a dry paper product or other object, such as a towel (not shown). The housing 12' of FIG. 4 may comprise first and second arms 14', 16' with a respective aperture 84-1, 84-2 extending through a thickness of each arm 14', 16'. The bar 104' may be inserted through the apertures 84-1, 84-2 formed in the arms 14', 16' to suspend the housing 12' below the fixed substrate 106'. The housing 12' may otherwise comprise the same structure as the housing 12 depicted in FIGS. 1, 3, and 6. In general, at least one of the arms, e.g., the second arm 16', of the housing 12' in FIG. 4 would need to be removed from the bar 104' to install or replace a conventional toilet tissue roll supported on the bar 104'. It is understood that the housing 12' in FIG. 4 could also be used with the fixed substrate 106 depicted in FIG. 3. It is also understood that the housing 12, 12' described herein could be used with any suitable fixed substrate, such as a recessed toilet tissue holder. In further examples, the housing 12, 12' may be used with a freestanding structure (not shown), such as a freestanding toilet tissue holder.

In all examples, when installed on the fixed substrate 106, 106', the arms 14, 16 and 14', 16' suspend the housing 12, 12' below the fixed substrate 106, 106' and below the toilet tissue roll 110, as shown in FIGS. 3, 4, and 6. The housing 12 may extend outward from the wall 108 no more than the posts 106A, 106B and/or the toilet tissue roll 110, and a greatest width of the housing 12 in a lateral direction may be no more than a lateral spacing between the posts 106A, 106B.

With reference to FIGS. 1 and 2A-2C, the cartridge 40 comprises a lid 42 and a main body 44 with a first side 46, a second side 48, a third side 50, a fourth side 52, a top 54, and a bottom 56. The lid 42 is coupled to the main body 44 by a hinge 58 extending longitudinally along at least a portion of the fourth side 52, as best seen in FIG. 1. The hinge 58 may comprise a strip of thin, flexible material adhered to the cartridge 40 and spanning between the lid 42 and the main body 44. The cartridge 40 may be opened by moving the lid 42 in a direction indicated by arrow C in FIG. 2C, in which the lid 42 pivots along the hinge 58 to allow access to an interior space (not labeled) of the cartridge 40.

Figure 2A:
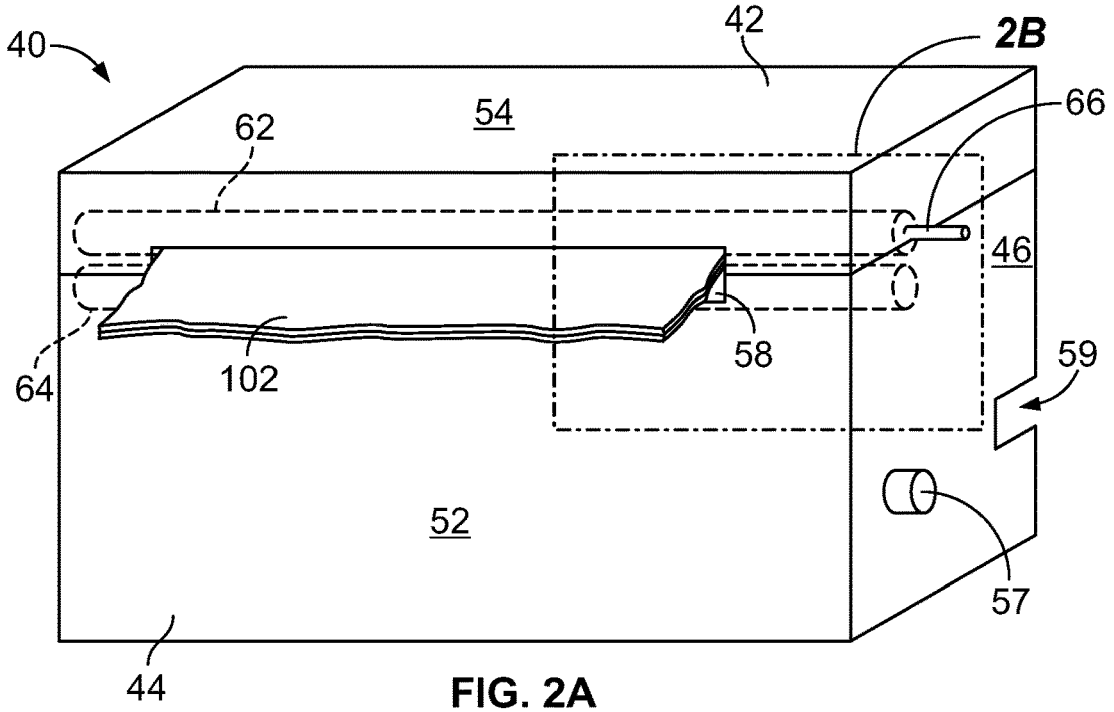
FIG. 2A is a front perspective view of the cartridge of FIG. 1.
Figure 2B:
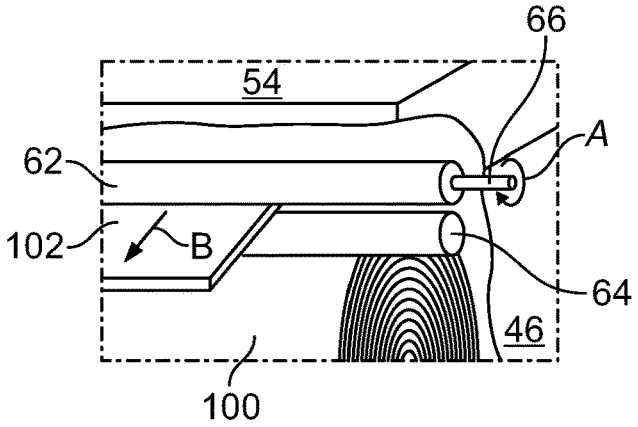
FIG. 2B is a detailed view of a portion of the cartridge of FIG. 2A.
Figure 2C:
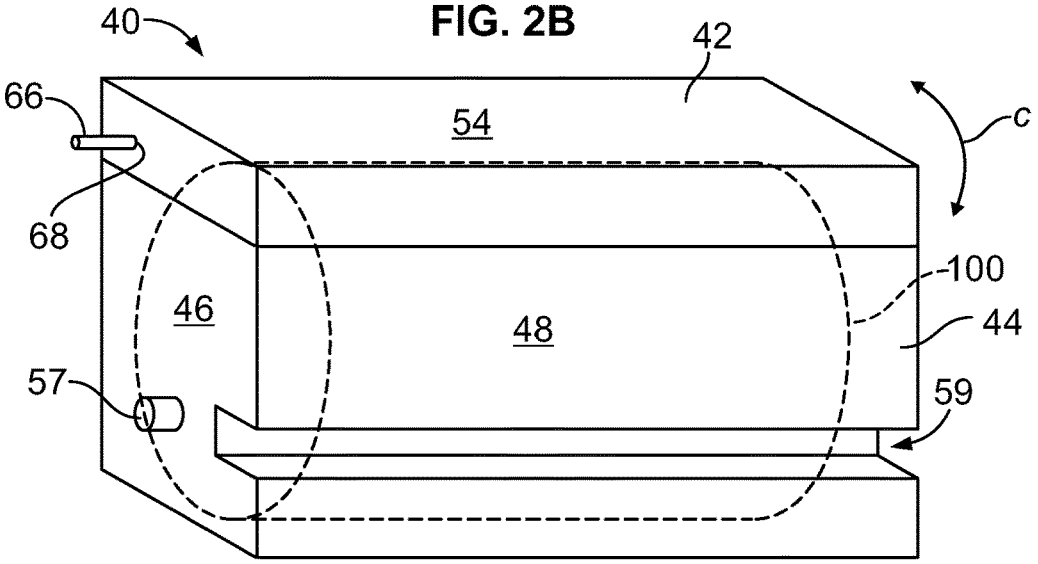
FIG. 2C is a back perspective view of the cartridge of FIG. 2A.

The cartridge 40 may be for dispensing a paper product 100, as shown in FIG. 2C. The cartridge 40 may accommodate a variety of wet paper products and may be refillable. The paper product 100 may comprise, for example, a rolled, continuous sheet of a pre-wetted paper product such as a personal wipe (commonly referred to as a wet wipe or moist towelette), which may be disposable and/or flushable (i.e., may be flushed down a toilet for disposal with other solid waste). As shown in FIG. 6, the paper product 100 may comprise perforations 104 that define individual sheets 102. In other examples (not shown), the paper product 100 may comprise a stacked wet paper product comprising a plurality of individual, folded sheets, in which the individual sheets are interleaved with and overlap adjacent sheets as shown in U.S. Pat. No. 6,213,344, the disclosure of which is hereby incorporated by reference in its entirety.

The cartridge 40 comprises an active roller 62 and a passive roller 64, as shown in FIGS. 2A and 2B. The active roller 62 is rotatably coupled to and contained in the lid 42. The active roller 62 comprises a shaft 66 that extends from one end of the active roller 62 through an aperture 68 formed in the lid 42, such that the shaft 66 protrudes from the cartridge 40. The passive roller 64 is rotatably coupled to and contained in the main body 44 of the cartridge 40 adjacent to the active roller 62.

With continued reference to FIGS. 1 and 2A-2C, to install the paper product 100 in the cartridge 40, the lid 42 is opened in the direction indicated by the arrow C and the paper product 100 is placed into the cartridge 40. A first sheet 102 of the rolled or stacked paper product 100 is placed over the passive roller 64 in the main body 44 and inserted into a slot 60 formed in the hinge 58 such that the sheet 102 extends through the slot 60 between the lid 42 and main body 44 and extends outward from the fourth side 52 of the cartridge 40. When the lid 42 is closed, the active roller 62 contacts the sheet 102 and compresses the paper product 100 between the active and passive rollers 62, 64. The active and passive rollers 62, 64 may be formed from and/or coated or covered with a non-slip or gripping material. One or both of the active roller 62 or the passive roller 64 may also comprise a spring or other structure (not shown) that biases the rollers 62, 64 toward each other.

The active and passive rollers 62, 64 together form a seal across the slot 60 through which the paper product 100 is dispensed. This seal may be partially watertight, which helps to reduce loss of moisture from the paper product 100. In addition, the cartridge 40 fully encloses the paper product 100 on all sides, which further helps to reduce loss of moisture from the paper product 100. Compression of the paper product 100 between the rollers 62, 64 also helps to prevent retraction or withdrawal of the paper product 100 back through the slot 60 and into the cartridge 40. While the hinge 58 may extend along all or part of the fourth side 52 of the cartridge, the slot 60 generally does not extend along an entirety of the fourth side 52, such that the active roller 62 directly contacts at least a section of the passive roller 64, e.g., at opposing ends of the rollers 62, 64 as shown in FIG. 2A. As described in more detail herein, the active and passive rollers 62, 64 cooperate to dispense sheets 102 of the paper product 100 via the slot 60 in a direction indicated by arrow B.

As shown in FIG. 1, the compartment 26 is enclosed on only four sides (e.g., by the side, top, and back panels 18, 20, 22, 24 of the housing 12), with a bottom and a front (not separately labeled) of the compartment 26 being open. One or more portions of the cartridge 40 may engage one or more structures formed on an inner surface (not separately labeled) of the compartment 26. The cartridge 40 may be aligned in the compartment 26 and secured to the housing 12 by engagement between the cartridge 40 and the housing 12. For example, an alignment indent 30 formed in an inner surface of the second side panel 20 of the housing 12 may receive a corresponding alignment protrusion 57 extending outward from an outer surface (not separately labeled) of the first side 46 of the cartridge 40, as seen in FIGS. 1 and 2A. Alternatively or in addition, the back panel 24 of the housing 12 may comprise an alignment ridge 32 extending along at least a section and extending outward from an inner surface of the back panel 24. The alignment ridge 32 may be received in a corresponding alignment recess 59 extending inward from an outer surface of the second side 52 of the cartridge 40, as seen in FIGS. 1 and 2C. The alignment recess 59 may extend longitudinally along at least a section of the second side 48 of the cartridge 40. The housing 12 may further comprise a clip 76 that is coupled to the first side panel 18. The clip 76 may comprise an "L" shape, with a first portion of the clip 76 extending parallel to the first side panel 18 toward the front of the compartment 26 and a second portion extending over the front of the compartment perpendicular to the first portion and to the first side panel 18. The clip 76 may comprise, for example, a thin strip of flexible material that may be substantially similar to the material of the housing 12. The clip 76 may further help to retain the cartridge 40 in the compartment 26, as described below. Alternatively or in addition to these structures, the third side 50 and/or top 54 of the cartridge 40 may comprise one or more structures (not shown) that engage corresponding structures (not shown) formed in an inner surface of the first side panel 18 and/or top panel 22 of the housing 12. It is understood that the one or more portions of the cartridge 40 and the corresponding structure(s) formed on the inner surface of the compartment 26 may comprise any suitable shape and/or dimension.

With reference to FIG. 1, the cartridge 40 may be installed into the housing 12 by grasping and pulling the second portion of the clip 76 outwardly from the first side panel 18 and inserting the first side 46 of the cartridge 40 into the compartment 26 at a slight angle such that the alignment protrusion 57 is partially received in the alignment indent 30 of the second side panel 20. The shaft 66 is received in an opening 34 formed in the second side panel 20, as described in more detail herein. The cartridge 40 may then be pushed toward the back panel 24 and straightened, such that the alignment ridge 32 is received in the alignment recess 59. The cartridge 40 may be received in the compartment 26 such that the fourth side 52 of the cartridge 40 is flush with adjacent sections of the side and top panels 18, 20, 22 of the housing 12, as shown in FIGS. 3 and 6. The clip 76 may then be released, and the second portion of the clip 76 may extend over the fourth side 52 of the cartridge 40 to hold the cartridge 40 in place and prevent the cartridge 40 from falling out of the front of the compartment 26, as shown in FIG. 6. The cartridge 40 may be removed from the housing 12 by pulling the second portion of the clip 76 outwardly from the first side panel 18 and reversing the remaining steps.

When installed, the cartridge 40 is held securely against the inner surfaces of one or more of the side, top, and back panels 18, 20, 22, 24 of the housing 12 by engagement between the clip 76 and the fourth side 52 of the cartridge 40 and by engagement between respective ones of the alignment indent and ridge 30, 32 of the housing 12 and the alignment protrusion and recess 57, 59 of the cartridge 40. Engagement between these portions of the housing 12 and the cartridge 40 aligns the cartridge 40 in the compartment 26 and prevents unwanted detachment of the cartridge 40 from the housing 12. In particular, engagement between the housing 12 and the cartridge 40 prevents the cartridge from falling through the open bottom of the compartment 26 and from sliding out of the open front of the compartment 26. Installation of the cartridge 40 into the housing 12 also helps to securely close the lid 42 of the cartridge 40 against the main body 44 to maintain compression of the paper product 100 between the active and passive rollers 62, 64, as shown in FIGS. 2A and 2B.

With reference to FIGS. 1, 3 and 4, a portion of the housing 12 adjacent to the compartment 26 may further comprise a gear compartment 36 that encloses a gear assembly 86. The gear compartment 36 may be defined on three sides by the second side panel 20, the top panel 22, and the back panel 24 of the housing 12 and on the other three sides by a front panel 37, a side panel 38, and a bottom panel 39. A lever 70 extends through a slot 72 formed in the front panel 37. The lever 70 is coupled to the gear assembly 86 and is used in cooperation with the rollers 62, 64 of the cartridge 40 to dispense sheets 102 of the paper product 100 from the cartridge 40, as described herein in more detail.

Figure 5:
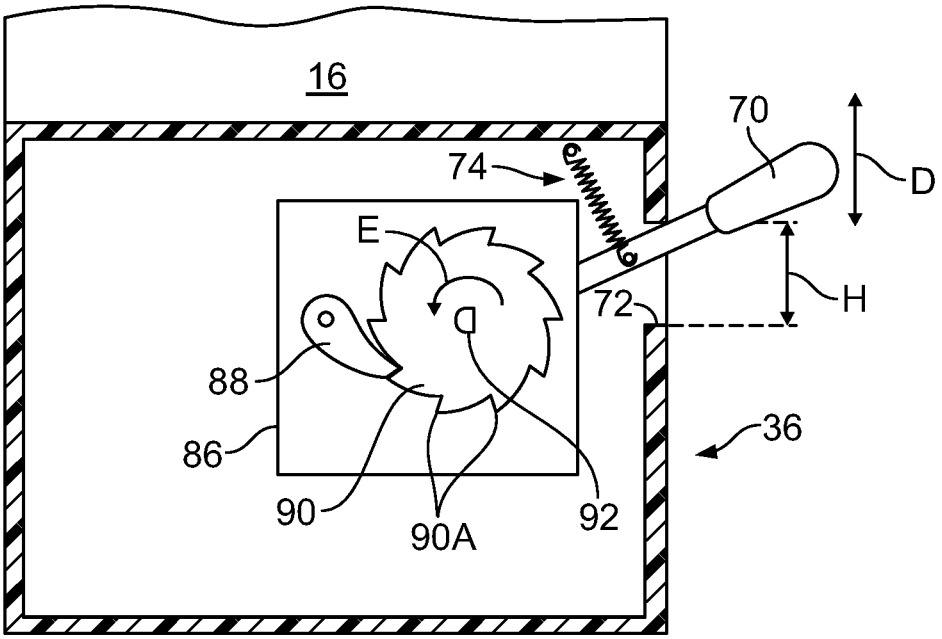
FIG. 5 is a cross-sectional view of a portion of the housing taken along line 5-5 in FIG. 1.

As shown in the cross-sectional schematic view of FIG. 5, the gear assembly 86 may comprise one or more gears arranged in one of several known configurations that allow metered movement of a dispensing gear 90. The lever 70 may be coupled, via one or more additional gears and/or other components (not shown), to the dispensing gear 90, such that depression of the lever 70 downward in a direction indicated by arrow D causes the dispensing gear 90 to rotate a predefined rotational distance in a direction indicated by arrow E. In one example, the dispensing gear 90 may comprise a ratchet that allows rotation in only one direction. As the lever 70 is depressed from a first position and the dispensing gear 90 rotates in the direction indicated by arrow E, a pawl 88 slides over each tooth 90A of the dispensing gear 90. When the lever 70 is released and moves upward, the pawl 88 prevents reverse rotation of the dispensing gear 90, i.e., in a direction opposite to the arrow E, as is known in the art. Although the dispensing gear 90 is depicted in FIG. 5 as a ratchet, the dispensing gear 90 may comprise any suitable type of gear, such as a conventional spur gear, and the gear assembly 86 may include gears with internal and/or external gears.

In other examples (not shown), the lever 70 may be coupled to a rack that engages a pinion, which may drive one or more additional gears to cause rotation of the dispensing gear 90 upon depression of the lever 70 in a known manner. Alternatively or in addition, the gear assembly 86 may comprise a conventional, single direction clutch (not shown) that disconnects the lever 70 from the dispensing gear 90 during the upward or return movement of the lever 70 to the first position, such that the upward movement of the lever 70 does not cause reverse rotation of the dispensing gear 90. Suitable lever-operated gear assembly structures are described, for example, in U.S. Pat. Nos. 4,406,421; 4,699,304; and 6,224,010, the disclosures of which are hereby incorporated by reference in their entirety.

Alternatively or in addition, the gear compartment 36 in further examples may comprise a winding mechanism with a wheel or knob 78 located on the side panel 38, as shown in FIG. 3. The knob 78 may comprise a shaft (not shown) that extends through the side panel 38 and is coupled to, for example, a spiral torsion spring (not shown). The spiral spring may be similar to a clock mainspring and may be coupled to a ratchet (not shown). As is known in the art, turning the knob 78 in one direction tightens the spiral spring, with the pawl preventing turning of the knob 78 in the opposite direction and unwinding of the spiral spring. The spiral spring may be coupled to the dispensing gear 90 (directly or via one or more additional gears), and the lever 70 may be coupled to an escapement (not shown) such that the spiral spring releases a metered amount of energy with each depression of the lever 70 in a known manner, causing the dispensing gear 90 to rotate the predefined rotational distance and dispense the paper product 100, as described herein. The knob 78 may be periodically turned to re-tighten the spiral spring as needed.

The gear compartment 36 may comprise a biasing mechanism that biases the lever 70 back to the first position following depression of the lever 70. The biasing mechanism may comprise, for example, an extension spring 74 that may be coupled at one end to the lever 70 and at the other end to an inner surface of the gear compartment 36. The lever 70 is depressed downward in the direction indicated by arrow D from the first position shown in FIG. 5, and upon release of the lever 70, the spring 74 biases the lever 70 upward to return the lever 70 to the first position. A height H of the slot 72 may at least partially determine a degree of upward and downward movement of the lever 70 in the direction indicated by the arrow D. The predefined rotational distance by which the dispensing gear 90 rotates upon depression of the lever 70 may be at least partially defined by the height H of the slot 72. Alternatively or in addition, when the dispensing gear 90 comprises a ratchet, the predefined rotational distance by which the dispensing gear 90 rotates upon depression of the lever 70 may be at least partially defined by a spacing between the teeth 90A of the dispensing gear 90. With reference to FIGS. 2B, 5, and 6, the predefined rotational distance may substantially correspond to a dimension between the perforations 104 that define the individual sheets 102 of the rolled paper product 100, in which the dimension between the perforations 104 is measured in the direction indicated by the arrow B. For a stacked paper product (not shown), the predefined rotational distance may substantially correspond to a dimension of the separate sheets.

As shown in FIGS. 1 and 5, the second side panel 20 of the housing 12 comprises an opening 34 that extends through a thickness of the gear compartment 36. The opening 34 aligns with a central aperture 92 of the dispensing gear 90. When the cartridge 40 is installed in the housing 12, the shaft 66 coupled to the active roller 62 extends through the opening 34 and is received in the central aperture 92 of the dispensing gear 90. The central aperture 92 may comprise a shape with, for example, an arcuate portion and a flattened portion (not separately labeled), as seen in FIG. 5. The shaft 66 may comprise a shape that corresponds to the shape of the central aperture 92, such that the shaft 66 moves in conjunction with the dispensing gear 90. In other examples (not shown), the central aperture 92 and shaft 66 may comprise a square or rectangular shape.

With reference to FIGS. 1, 2A, 2B, and 5, depression of the lever 70 causes the dispensing gear 90 to rotate the predefined rotational distance in the direction indicated by arrow E. Rotation of the dispensing gear 90 causes the shaft 66 of the active roller 62 to rotate a corresponding rotational distance in a direction indicated by arrow A. Because the active and passive rollers 62, 64 contact each other and compress the sheet 102 of the paper product 100 between them, friction between the active and passive rollers 62, 64 causes the passive roller 64 to rotate in a direction opposite to the arrow A. This rotation of the active and passive rollers 62, 64 causes the sheet 102 of the rolled or stacked paper product 100 extending from the slot 60 to move in the direction indicated by arrow B. In this manner, sheets 102 of the paper product 100 are dispensed one at a time from the cartridge 40. Upon release, the spring 74 biases the lever 70 upward and returns the lever 70 to the first position in preparation for one or more subsequent depressions of the lever 70 and dispensation of one or more additional sheets 102 of the paper product 100. Compression of the paper product 100 between the active and passive rollers 62, 64 keeps the paper product 100 from retracting back into the cartridge 40 between depressions of the lever 70. Upon depletion of the paper product 100, the cartridge 40 may be removed from the housing 12 as described herein for refilling or disposal.

Dispensing assemblies in accordance with the present disclosure provide a number of advantages over known combination dispensers. For example, attachment of the dispensing assembly to a fixed substrate such as a wall-mounted, toilet tissue holder places the personal wipes within easy reach for use in combination with dry paper products such as a conventional toilet tissue roll. There is generally no need to install an additional or specific holder especially for the dispensing assembly, as the housing can typically be installed on an existing holder. There is also generally no need to modify the existing holder, the wall, or any other adjacent structure to accommodate the dispensing assembly. The compact housing hangs below the fixed substrate to take advantage of unused space, while allowing unencumbered access to the dry paper products positioned above the compartment that receives the cartridge. The cartridge may accommodate a variety of different rolled and stacked wet paper products and provides for easy installation and removal by a consumer. The cartridge helps to prevent moisture loss in the case of a pre-wetted paper product by enclosure of the paper product on all sides and formation of a seal between the active and passive rollers near the slot from which the paper product is dispensed. The cartridge may be reusable and/or refillable, and the housing and cartridge may be recycled at the end of their life cycles.

Having thus described the invention of the present application in detail and by reference to embodiments thereof, it will be apparent that modifications and variations are possible without departing from the scope of the invention defined in the appended claims.

What is claimed is:

1. A dispensing assembly, comprising:

a housing comprising a first side panel, a second side panel, a top panel, and a back panel that together define a compartment;

a cartridge for dispensing a paper product, the cartridge being removably received in the compartment of the housing, wherein:

the cartridge comprises a first side, a second side, a third side, a fourth side, a top, and a bottom, the first side of the cartridge defining an aperture for accommodating a drive shaft for advancing the paper product; and one or more portions of the cartridge engage one or more structures formed on an inner surface of the compartment; and an actuation device operatively coupled to the drive shaft, the actuation device being disposed in the housing, and the actuation device configured to advance the paper product by means of the drive shaft wherein: the cartridge further comprises a lid and a main body, the lid comprising an active roller and the main body comprising a passive roller, the active roller being operatively coupled to the drive shaft; and when the lid is closed, the active and passive rollers are adjacent to one another and the paper product is compressed between the active and passive rollers.

2. The dispensing assembly of claim 1, wherein a bottom and a front of the compartment are open.

3. The dispensing assembly of claim 1, further comprising a pair of arms that suspend the housing below a spindle.

4. The dispensing assembly of claim 1, wherein the cartridge is aligned in the compartment and secured to the housing by engagement between the one or more portions of the cartridge and the one or more structures formed on the inner surface of the compartment.

5. The dispensing assembly of claim 1, wherein:

an alignment indent formed in an inner surface of the second side panel of the housing receives an alignment protrusion extending outward from an outer surface of the first side of the cartridge; and an alignment ridge extending outward from an inner surface of the back panel of the housing is received in an alignment recess extending inward from an outer surface of the second side of the cartridge.

6. The dispensing assembly of claim 1, wherein the actuation device further comprises a gear and a spring, the gear being coupled to a lever and to the active roller via the drive shaft, wherein:

when the lever is depressed from a first position, the gear and the active roller rotate a predefined rotational distance to advance the paper product; and when the lever is released, the spring biases the lever back to the first position.

7. The dispensing assembly of claim 1, wherein the paper product comprises a pre-wetted paper product, the active and passive rollers together defining a seal that is partially watertight.

8. The dispensing assembly of claim 1, wherein the lid of the cartridge is coupled to the main body by a hinge extending longitudinally along at least a portion of the fourth side of the cartridge, the paper product being dispensed from a slot formed in the hinge.

9. The dispensing assembly of claim 1, wherein the dispensing assembly is configured to be attached to a wall-mounted toilet tissue holder, the dispensing assembly further comprising a pair of arms that suspend the housing below the wall-mounted toilet tissue holder, wherein each of the pair of arms further comprises:

a protrusion extending outward from an outer surface for mounting the dispensing assembly to posts of the wall-mounted toilet tissue holder; and an indent extending inward from an inner surface for receiving a spindle that supports a roll of a second paper product.

10. A dispensing assembly attachable to a fixed substrate, the dispensing assembly comprising:

a housing comprising a first side panel, a second side panel, a top panel, and a back panel that together define a compartment; and a cartridge for dispensing a paper product, the cartridge being removably received in the compartment of the housing, wherein:

the cartridge comprises a lid with an active roller and a main body with a passive roller, the lid of the cartridge being coupled to the main body by a hinge, wherein the paper product is dispensed from a slot formed in the hinge; and when the lid is closed, the active and passive rollers are adjacent to one another and the paper product is compressed between the active and passive rollers.

11. The dispensing assembly of claim 10, wherein a bottom and a front of the compartment are open.

12. The dispensing assembly of claim 10, further comprising a pair of arms that suspend the housing below the fixed substrate.

13. The dispensing assembly of claim 10, wherein the cartridge comprises a first side, a second side, a third side, a fourth side, a top, and a bottom and wherein:

an alignment indent formed in an inner surface of the second side panel of the housing receives an alignment protrusion extending outward from an outer surface of the first side of the cartridge;

an alignment ridge extending outward from an inner surface of the back panel of the housing is received in an alignment recess extending inward from an outer surface of the second side of the cartridge; and wherein the cartridge is aligned in the compartment and secured to the housing by engagement between the alignment indent and protrusion and between the alignment ridge and recess.

14. The dispensing assembly of claim 10, further comprising a gear and a spring, the gear being coupled to a lever and to the active roller, wherein:

when the lever is depressed from a first position, the gear and the active roller rotate a predefined rotational distance to advance the paper product; and when the lever is released, the spring biases the lever back to the first position.

15. The dispensing assembly of claim 10, wherein the paper product comprises a pre-wetted paper product, the active and passive rollers together defining a seal that is partially watertight.

16. The dispensing assembly of claim 10, wherein the fixed substrate comprises a wall-mounted toilet tissue holder, the dispensing assembly further comprising a pair of arms that suspend the housing below the fixed substrate, wherein each of the pair of arms further comprises:

a protrusion extending outward from an outer surface for mounting the dispensing assembly to posts of the toilet tissue holder; and an indent extending inward from an inner surface for receiving a spindle that supports a roll of a second paper product.

17. A cartridge for dispensing a paper product, the cartridge comprising:

a lid comprising an active roller, the lid defining an aperture for accommodating a drive shaft for advancing the paper product, the drive shaft configured to operatively couple the active roller to an actuation device located outside of the cartridge; and a main body comprising a passive roller;

wherein:

the lid is coupled to the main body by a hinge extending longitudinally along at least a portion of one side of the cartridge; and when the lid is closed, the active and passive rollers are adjacent to one another and the paper product is compressed between the active and passive rollers.

18. The cartridge of claim 17, wherein the paper product comprises a pre-wetted paper product, the active and passive rollers together defining a seal that is partially watertight.

19. The cartridge of claim 17, wherein the paper product is dispensed from a slot formed in the hinge.

* * * * *